United States Patent [19]

Gudelis et al.

[11] Patent Number: 4,460,453

[45] Date of Patent: Jul. 17, 1984

[54] SOLVENT DEWAXING WAXY BRIGHT STOCK USING A COMBINATION POLYDIALKYL FUMARATE-VINYL ACETATE COPOLYMER AND POLYALKYL (METH-) ACRYLATE POLYMER DEWAXING AID

[75] Inventors: David A. Gudelis; Lloyd E. Reid, both of Sarnia, Canada

[73] Assignee: Exxon Research and Engineering Co., Florham Park, N.J.

[21] Appl. No.: 426,710

[22] Filed: Sep. 29, 1982

[51] Int. Cl.[3] ..... C10G 73/04

[52] U.S. Cl. ..... 208/33

[58] Field of Search ..... 208/33

[56] References Cited

U.S. PATENT DOCUMENTS

| | | | |
|---|---|---|---|
| 2,798,027 | 7/1957 | Cohen | 196/19 |
| 3,239,445 | 3/1966 | Leonard et al. | 208/33 |
| 3,262,873 | 7/1966 | Tiedje et al. | 208/33 |
| 3,458,430 | 7/1969 | Henselman et al. | 208/33 |
| 3,475,321 | 10/1969 | Henselman | 208/33 |
| 3,479,278 | 11/1969 | DeVault | 208/33 |
| 3,729,296 | 4/1973 | Miller | 44/62 |
| 3,806,442 | 4/1974 | Reid et al. | 208/33 |
| 3,854,893 | 12/1974 | Rossi | 44/62 |
| 4,088,589 | 5/1978 | Rossi et al. | 252/56 |
| 4,153,423 | 5/1979 | Wisotsky | 44/62 |
| 4,191,631 | 3/1980 | Grisham | 208/33 |

FOREIGN PATENT DOCUMENTS

| | | | |
|---|---|---|---|
| 1248203 | 8/1967 | Fed. Rep. of Germany . | |
| 1248201 | 8/1967 | Fed. Rep. of Germany . | |
| 2113780 | 6/1972 | France . | |
| 44516 | 5/1970 | Japan . | |
| 122277 | 12/1970 | Japan . | |
| 122276 | 12/1970 | Japan . | |
| 44261 | 4/1977 | Japan . | |
| 77382 | 6/1977 | Japan . | |
| 930968 | 7/1963 | United Kingdom . | |
| 945828 | 1/1964 | United Kingdom | 208/33 |
| 1145427 | 3/1969 | United Kingdom | 208/33 |
| 1151385 | 5/1969 | United Kingdom . | |
| 810668 | 12/1978 | U.S.S.R. . | |

*Primary Examiner*—Delbert E. Gantz
*Assistant Examiner*—Glenn A. Caldarola
*Attorney, Agent, or Firm*—Joseph J. Allocca

[57] ABSTRACT

It has been discovered that (a) poly di alkyl fumarate/-vinyl acetate copolymers in combination with (B) poly alkyl (meth-) acrylate polymers are effective dewaxing aids for the solvent dewaxing of bright stocks. The poly di alkyl fumarate/vinyl acetate copolymer component of the combination dewaxing aid used in the process of the present invention has a number average molecular weight of about 1000 to 100,000 and possesses alkyl side chain moieties of from $C_{16}$–$C_{24}$+ in length (excluding branching) with a pendent side chain length of predominantly (>50%) $C_{20}$. The polyalkyl (meth-) acrylate is the polymeric ester of aliphatic alcohols having groups 10 to 20 carbons in length, excluding branching (pendent side chain length predominantly (>50%) $C_{14}$ and lower) and acrylic or (meth-) acrylic acid (preferably methacrylic acid) and possesses a number average molecular weight of at least 5,000. The solvent dewaxing processes benefitted by the use of the present combination are those using standard normally liquid solvents such as $C_3$–$C_6$ ketones, aromatic hydrocarbons, halogenated hydrocarbons and mixtures thereof. The waxy hydrocarbon oil dewaxed is a bright stock. The dewaxing aid combination may be used at dose level of from about 0.005 to 5 wt. % active ingredient at a component A/B ratio of about 4/1 to 1/100, preferably about 1/1 to 1/20, and most preferably about 1/3.

5 Claims, 1 Drawing Figure

EVALUATION OF POLYMETHACYLATE (ACRYLOID 150) – POLYDIALKYLFUMARATE VINYLACETATE COPOLYMER SYNERGISTIC MIXTURE IN ARAMCO BRIGHT STOCK UNDER PREDILUTION CONDITIONS

DWO Relative Filtration Rate Versus Dewaxing Aid Mixture Composition
Total Additive Treat = 0.05 wt % A.I. (Based on Oil Feed)

SOLVENT DEWAXING WAXY BRIGHT STOCK USING A COMBINATION POLYDIALKYL FUMARATE-VINYL ACETATE COPOLYMER AND POLYALKYL (METH-) ACRYLATE POLYMER DEWAXING AID

DESCRIPTION OF THE INVENTION

This invention relates to processes for solvent dewaxing waxy bright stock oil employing a dewaxing aid which dewaxing aid is a mixture of (a) poly di alkyl fumarate/vinyl acetate copolymer and (b) poly alkyl (meth-) acrylate polymers. The dewaxing aid mixture is a mixture of (A) poly di alkyl fumarate/vinyl acetate copolymer having a number average molecular weight of about 1,000 to 100,000, preferably 5,000 to 50,000, possessing alkyl side chain moieties of from $C_{16}$-$C_{24}$+ in length (excluding branching) with an average pendent side chain length of predominantly (i.e. >50%) $C_{20}$ and (B) polyalkyl (meth-) acrylate which is the polymeric ester of aliphatic alcohols of 10–20 carbons in length (excluding branching) (>50% $C_{14}$ and lower) and acrylic or (meth-) acylic acid (preferably methacrylic acid) and which polymer possesses a number average molecular weight of about 5,000 and greater.

The solvent dewaxing processes benefitted by the use of the present combination dewaxing aid are those using normally liquid solvent systems such as $C_3$-$C_6$ ketones, aromatic hydrocarbons, halogenated hydrocarbons, and mixtures thereof.

The waxy oil is a bright stock raffinate from such typical sources as Light Arabian, Kuwait, North Louisiana, West Texas Sour, Western Canadian, Cold Lake Heavy Crude etc. The raffinate can be derived from the crude oil or mixture of crude oils by vacuum distillation followed by conventional propane deasphalting of the vacuum residuum to remove the asphaltenes. The resulting deasphalted oil is solvent extracted using either NMP, phenol, or furfural, etc. to remove the remaining undesirable aromatics to give a waxy raffinate for subsequent dewaxing. Typical bright stock waxy raffinates have a boiling range of about 500°-700° C., density of about 0.85–0.92 g/cc @ 15° C., a viscosity of about 25-37 cSt/100° C., a pour point of 60°-70° C., a dry wax content of 15-25 wt.% for about −9° C. pour point and a Conradson carbon residue value of about 0.3-2.0.

The dewaxing aid combination may be used at a dose level of from about 0.005 to 5.0 wt.% active ingredient (A.I.) preferably about 0.01 to 0.5 wt.% at a component A/B ratio of about 4/1 to 1/100, preferably about 1/1 to 1/20, most preferably about 1/3.

This dewaxing aid combination aids in solvent dewaxing processes wherein a waxy bright stock is mixed with a normally liquid dewaxing solvent and a quantity of the recited dewaxing aid combination to form a mixture which is chilled either directly using cold dewaxing solvent or indirectly in heat exchange apparatus to form a slurry comprising wax particles and a solution of dewaxed oil and dewaxing solvent. The dewaxing aid components (a) and (b) may be precombined one with the other for addition to the waxy bright stock to be dewaxed, either as such or diluted in a suitable wax-free oil to improve flow properties. Alternatively, the components may be added separately and simultaneously or separately and sequentially at the same or separate points within the process. Even in this embodiment the individual components (A) and (B) may be employed as such or diluted in a suitable wax-free oil to improve flow properties. The wax particles which are precipitated are subsequently separated from the dewaxed oil by any of a number of typical liquid/solid separation processes exemplified by, but not limited to, filtration, settling, centrifugation, etc.

The use of the combination (A) plus (B) results in increased separation rates as compared to using no aid at all or using either component individually.

BACKGROUND OF THE INVENTION

Waxes in wax-containing hydrocarbon oils are removed therefrom by chilling the oil to precipitate out the wax and then separating the solid wax particles from the dewaxed oil by solid/liquid separation procedures such as filtration, centrifugation, settling, etc. Industrial dewaxing processes include press dewaxing processes wherein the wax-containing oil, in the absence of solvent, is chilled to crystallize out the wax particles, which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals thereby forming a slurry comprising solid wax particles and a solution of dewaxed oil containing dewaxing solvent. The slurry is then fed to a wax separator (e.g. filter) wherein the wax is removed from the dewaxed oil and dewaxing solvent. Solvent dewaxing processes are used for heavier oil fractions such as lubricating oil distillates and bright stocks. Typical dewaxing solvents include low boiling point, normally gaseous autorefrigerative hydrocarbons such as propane, propylene, butane, pentane, etc., and normally liquid solvents, e.g., ketones such as acetone, methyl ethyl ketone (MEK), methyl isobutyl ketone (MIBK) and mixtures thereof, aromatic hydrocarbons such as benzene, toluene and xylene as well as mixtures of ketones and aromatic hydrocarbons such as MEK/toluene and acetone/benzene and mixtures of normally liquid solvents such as ketones with autorefrigerants such as acetone/propylene.

One of the factors tending to limit the capacity of a solvent dewaxing plant is the rate of wax filtration (and separation in general) from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling conditions. The size and structure of the precipitated wax crystals, occlusion of oil in the wax crystal and the condition and quantity of the oil left in the crystal are extremely varied and depend on the wax composition and precipitation conditions. These conditions also affect the separation (e.g. filtration) rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of improving the filtration rate and minimizing haze formation is to add a dewaxing aid to the wax containing oil during the dewaxing process. Well known in the industry are dewaxing aids such as α-olefin copolymers; mixtures of materials such as a mixture of (a) an ethylene-vinyl acetate copolymer and (b) an ester of an aliphatic alcohol having from 2 to 20 carbon atoms with acrylic or methacrylic acid; materials such as the esters of aliphatic alcohols and acrylic or methacrylic acid, as well as polymeric dewaxing aids comprising condensation products of chlorinated paraffins and naphthalenes alone or mixed with the aforementioned esters. However, in the case of heavy stocks, these aids are not too efficient, requiring a relatively high concentration of the dewaxing aid in the oil. This is especially true when a heavy oil raffinate or a bright stock or heavy distillate is solvent dewaxed. Because of the presence of many fine particles of wax in the oil, the filter rate of the dewaxed oil tends to be low and the oil also may possess or develop a haze.

The identification of dewaxing aids which assist in dewaxing bright stocks is therefore of importance.

SUMMARY OF THE PRESENT INVENTION

Figure 1:
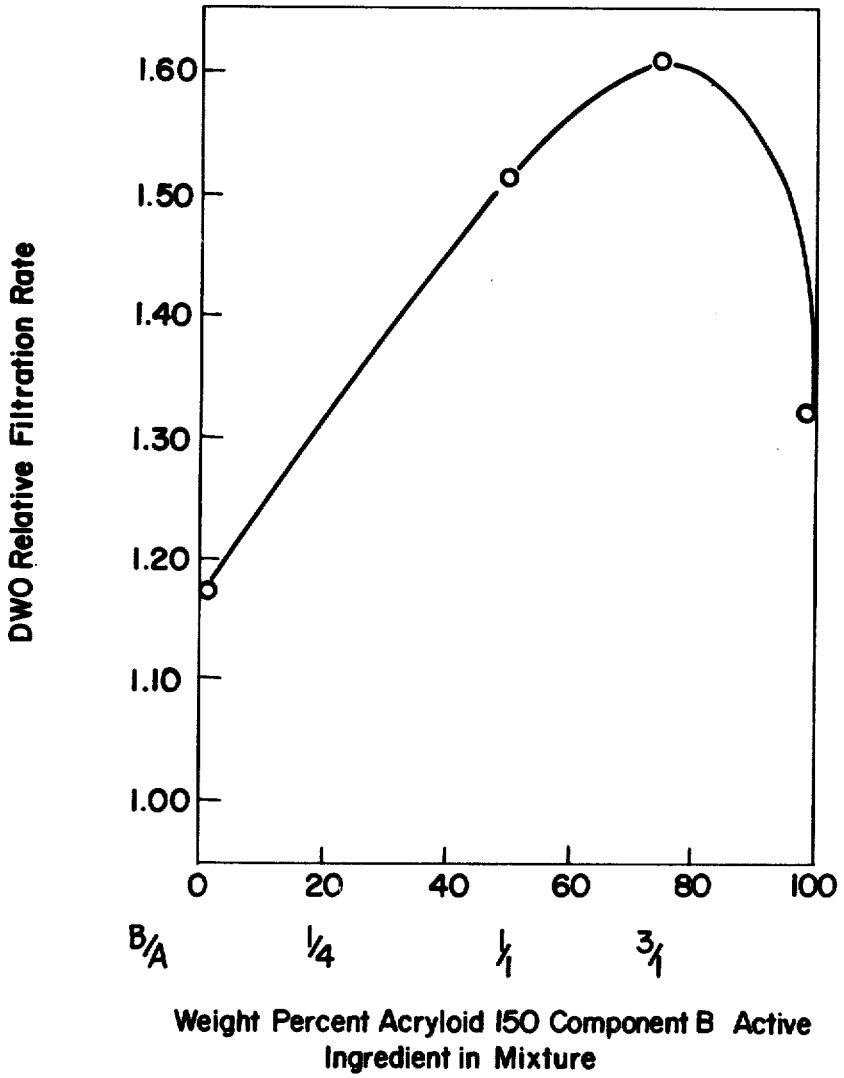
FIG. 1 presents the Dewaxed Oil Relative Filtration Rate versus the Dewaxing Aid Mixture Composition used in the present invention on Bright Stock.

This invention relates to processes for solvent dewaxing waxy bright stock oil employing a dewaxing aid which dewaxing aid is a mixture of (a) poly di alkyl furmarate/vinyl acetate copolymer and (b) poly alkyl (meth-) acrylate polymers. The dewaxing aid mixture is a mixture of (A) poly di alkyl furmarate/vinyl acetate copolymer having a number average molecular weight of about 1,000 to 100,000, preferably 5,000 to 50,000, possessing alkyl side chain moieties of from $C_{16}$-$C_{24}$+ in length (excluding branching) with an average pendent side chain length of predominantly (i.e. >50%) $C_{20}$ (preferably the pendent alkyl side chain groups are substantially linear, i.e. little or no branching) and (B) polyalkyl (meth-) acrylate which is the polymeric ester of aliphatic alcohols of 10-20 carbons in length (excluding branching), predominantly >50% $C_{14}$ and lower and acrylic or (meth-) acylic acid preferably methacrylic acid and which polymer possesses a number average molecular weight of about 5,000 or greater.

The dewaxing aid combination may be used at a dose level of from about 0.005 to 5.0 wt.% active ingredient, preferably about 0.01 to 0.5 wt.% at a component A/B ratio of about 4/1 to 1/100, preferably about 1/1 to 1/20, most preferably about 1/3.

This dewaxing aid is advantageously employed as separately prepared components (a) and (b). These components may then be mixed together in the previously recited ratios and added at the desired dose level, either as such or dissolved in a suitable wax-free oil such as mineral oil or other suitable solvent such as toluene, benzene, propane, methylene chloride and the like which imparts to the additive improved flow properties, pumpability, etc. Alternatively, the individual components (a) and (b) can be employed separately (either as such or dissolved in a solvent as previously indicated) and introduced to the dewaxing process simultaneously or sequentially at separate points within the process. The aid, regardless of whether both components are premixed one with the other, or employed separately/simultaneously or separately/sequentially with or without dilution, may be either mixed with the waxy oil prior to chilling, or introduced during the chilling process in either indirect chilling means, such as scraped surface chillers, or alternatively, direct chilling means employing cold normally liquid solvent. Preferred direct chilling means employing cold normally liquid solvent injected along a number of stages therein a number of which stages are highly agitated insuring instantaneous mixing is the DILCHILL® (registered service mark of Exxon Research and Engineering Company) process as presented in U.S. Pat. No. 3,773,650, hereby incorporated by reference.

The polydialkylfumarate has alkyl side chain groups of from 16 to 24+ carbon atoms in length (excluding branching), with an average pendent side chain length of predominantly (>50%) $C_{20}$. U.S. Pat. No. 3,729,296 describes polydialkylfumarate/vinyl acetate copolymers and a method for preparing them.

The polymer of the ester of an aliphatic alcohol with methacrylic or acrylic acid used as component (B) is a polymer of an ester of at least one aliphatic alcohol having an average side chain length of from about 10 to 20 (excluding branching), predominantly (>50%) $C_{14}$ and lower carbon atoms. The polymer will have a number average molecular weight greater than about 5,000. A commercial (meth)-acrylic-ester polymer having the needed characteristics for use in this invention is Acryloid 150 available from Rohm and Haas Company. This material, which is a preferred embodiment, is described as having an average side chain carbon number >50%, $C_{14}$ and lower and a number average molecular weight of about 5,000 to 200,000, preferably 10,000 to 100,000.

Samples of materials representative of those both within the scope and outside the scope of the present invention and employed in the Examples of this specification were examined and were determined to have the following general characteristics.

A poly di-n-alkyl fumarate-vinyl acetate copolymer having predominantly $C_{20}$ pendent alkyl side chains (63% $C_{20}$, 25% $C_{22}$, 12% other) which is representative of the materials within the scope of the present invention possessed a number average molecular weight of about 26,400 and a weight average molecular weight of about 110,000 with a 10-90 mole % number average molecular weight of about 5,000 to 70,000.

A representative poly di-n-alkyl fumarate-vinyl acetate copolymer having predominantly $C_{22}$ pendent alkyl side chains (behenyl side chains) (70% $C_{22}$, 15% $C_{20}$, 15% $C_{18}$) not within the scope of the present invention possessed a number average molecular weight of about 8,600 and a weight average molecular weight of about 60,900, with a 10-90 mole % number average molecular weight of about 1,000 to 20,000.

A representative poly alkyl meth-acrylate copolymer of the type identified as Acryloid 150 having predominantly $C_{12}$-$C_{16}$ pendent alkyl side chains (2% $C_{10}$, 30% $C_{12}$, 27% $C_{14}$, 14% $C_{16}$, 16% $C_{18}$, 11% $C_{20}$) possessed a number average molecular weight of about 62,200 and a weight average molecular weight of about 284,000, with a 10-90 mole % number average molecular weight of about 5,000 to 20,000.

A representative poly alkyl meth-acrylate copolymer of the type identified as Acryloid 144 having predominantly $C_{16}$-$C_{18}$ pendent alkyl side chains (4% $C_{12}$, 7% $C_{14}$, 39% $C_{16}$, 45% $C_{18}$, 5% $C_{20}$) possessed a number average molecular weight of about 33,300, a weight average molecular weight of about 205,800, with a 10-90 mole % number average molecular weight of about 5,000 to 75,000.

Molecular weights were determined by gel permeation chromatography calibrated on polystyrene.

While the samples presented above were not the exact samples employed in the Examples of the present specification, it is believed they are fairly representative of such samples and serve to demonstrate the general characteristics of materials which satisfy the requirement of the present invention, as well as of those which do not so satisfy those requirements.

The dewaxing solvent that is used in the present invention is not particularly critical; thus, any of the well-known normally liquid dewaxing solvents can be used. For example, ketones having from 3 to 6 carbon atoms, such as acetone, dimethyl ketone, methyl ethyl ketone, methyl propyl ketone and methyl isobutyl ketone and mixtures thereof, aromatic hydrocarbons such as benzene, xylene or toluene, mixtures of ketones and aromatic hydrocarbons such as methyl ethyl ketone/toluene or methyl isobutyl ketone/toluene. Also useful are halogenated hydrocarbons such as methylene chloride. Further, N-alkylpyrrolidones such as N-methylpyrrolidone and N-ethyl-pyrrolidone may be used as components of the dewaxing solvent. Normally liquid solvents which may be especially preferred for practicing the process of the present invention include aromatic hydrocarbons such as toluene, $C_5$–$C_6$ ketones such as MEK, MIBK and mixtures thereof, mixtures of a ketone and an an aromatic hydrocarbon such as MEK/-toluene, halogenated hydrocarbons such as methylene chloride, and mixtures of acetone and methylene chloride.

The waxy oil is a bright stock raffinate from such typical sources as Light Arabian, Kuwait, North Louisiana, West Texas Sour, Western Canadian, Cold Lake Heavy Crude etc. The raffinate can be derived from the crude oil or mixture or crude oils by vacuum distillation followed by conventional propane deasphalting of the vacuum residuum to remove the asphaltenes. The resulting deasphalted oil is solvent extracted using either NMP, phenol, or furfural, etc. to remove the remaining undesirable aromatics to give a waxy raffinate for subsequent dewaxing. Typical bright stock waxy raffinates have a boiling range of about 500°–700° C., density of about 0.85–0.92 g/cc @ 15° C., a viscosity of about 25–37 cSt/100° C., a pour point of 60°–70° C., a dry wax content of 15–25 wt.% for about −9° C. pour point and a conradson carbon residue value of about 0.3–2.0. A sample of a typical bright stock, Arab Light 2500N, was examined and was found to have a boiling range of 500°–700° C., a density of 0.89 g/cc @ 15° C., a viscosity of 32 cSt/100° C., a pour point of 65° C. and a dry wax content of 16 wt%. Preferably the bright stock is a lube oil or specialty oil fraction.

In an embodiment of the process of this invention, a solution of dewaxing aid comprising components (A) and (B) dissolved in an appropriate solvent such as a light heating oil or a light dewaxed mineral oil fraction is mixed into the wax-containing oil and the mixture heated to a temperature higher than the cloud point of the oil (about 50° to 120° C.). This mixture is introduced, along with the dewaxing solvent, into a chilling zone and chilled to a temperature necessary to yield the desired pour point for the resulting dewaxed oil. The chilling produces a slurry comprising dewaxed oil and solvent along with solid particles of wax which contain the dewaxing aid. This slurry is then sent to a wax filter to separate the dewaxed oil and solvent from the wax particles. The dewaxing temperature or temperature to which the slurry is chilled varies depending on the feed and conditions.

EXAMPLE 1

The feed preparation apparatus consisted of a 15 cm diameter stainless steel beaker, fitted with a U-shaped, teflon-edged scraper driven at 12 rpm. Chilling rates were controlled by a cooling reservoir surrounding the dewaxing beaker. Measured samples of hot waxy bright stock raffinate and dewaxing solvent were premixed and heated to form a clear solution. The resulting mixture was chilled with scraped surface agitation to the filtering temperature at a specified chilling rate. Filtration was accomplished with a filter leaf equipped with a dual layer of cotton over nylon.

Rotary filter operation was simulated by immersing the filter leaf in the slurry, moving it up and down to provide agitation and applying a pressure differential of 12" Hg across the filter leaf for a required time period. At the end of the required filtration time, the filter leaf was removed and immediately a proportionate amount of wash (prechilled to the filtering temperature) was passed through the cake. The end of the washing period was taken when the last of the wash solvent was just disappearing into the cake. The vacuum was then immediately released and the filter cake and filtrate were collected. After stripping the solvent from the filtrate and filter cake, the weights of dewaxed oil and slack wax were recorded.

Filter rate was calculated in U.S. gallons of dewaxed oil (or feed) per square foot per hour. Yield was expressed as percent dewaxed oil on recovered waxy feed.

An identical dewaxing-filtration procedure was followed with a dewaxing aid added to the waxy oil/solvent mixture. The dewaxing aid was usually dissolved in a small portion of hot oil to form a concentrate, which, in turn, could be dissolved readily in the hot waxy oil/solvent mixture prior to chilling.

The waxy bright stock was an Arab Light 2500N bright stock waxy raffinate, waxy viscosity 26 cSt/100° C. and 94 VI at −9° C. pour point.

Component B in the example is commercial Acryloid 150. Acryloid 150 is described in U.S. Pat. No. 4,153,423, U.S. Pat. No. 2,091,627 and U.S. Pat. No. 2,100,993.

Component A is a poly di-n-alkyl furmarate/vinyl acetate copolymer having side chains comprised of alkyl groups in the following approximate proportions:

A:63% $C_{20}$, 25% $C_{22}$, 12% Other as previously indicated. Poly di-n-alkyl fumarate/vinyl acetate copolymers are generally prepared by copolymerizing vinyl acetate and di alkyl fumarate following the procedure generally described in U.S. Pat. No. 3,729,296.

The results of this Example are presented in Table I and graphically in FIG. I. It is clear that the combination Acryloid 150/A, is superior to each component individually and markedly superior to no aid at all.

TABLE 1

EVALUATION OF A/B SYNERGISTIC MIXTURE IN ARAB LIGHT BRIGHT STOCK 2500N WAXY RAFFINATE UNDER PREDILUTION CONDITIONS

Solvent = MEK/Toluene (50/50 LV %);
Solvent Dilution Ratio = 4:1 W/W;
Average Chilling Rate = 2.2° C./min;
Filtering Temperature = −23° C.
A.I. = active ingredient

| Run No. | 1 | 2 | 3 | 4 | 5 | 6 |
|---|---|---|---|---|---|---|
| Dewaxing Aid | None | | Acryloid 150 | A | Acryloid 150/A | |
| Comsumption, Wt % A.I. on Oil Feed | 0 | | 0.05 | 0.05 | 0.05 | |
| Composition, wt % A.I. | | | | | | |
| Acryloid 150 | 0 | 0 | 100 | 0 | 75 | 50 |
| A | 0 | 0 | 0 | 100 | 25 | 50 |
| Filtration Cycle (sec)(1) | | | | | | |
| Filter Time | 60 | 60 | 60 | 60 | 60 | 60 |
| Wash Time | 60 | 60 | 60 | 60 | 43 | 40 |
| Wash Solvent/Feed, W/W | 1.6 | 1.7 | 1.7 | 3.4 | 1.7 | 1.8 |
| DWO Yield, wt % | | | | | | |
| Before Cake Wash | 61.8 | 62.2 | 61.3 | 71.5 | 69.5 | 70.1 |
| After Cake Wash | 83.3 | 82.6 | 84.1 | 85.0 | 83.8 | 84.3 |
| Wax Oil Content, wt %(2) | | | | | | |
| Before Cake Wash | 58.1 | 56.8 | 55.3 | 41.1 | 45.1 | 41.7 |
| After Cake Wash | 10.8 | 11.9 | 7.9 | 3.2 | 2.9 | 5.6 |
| Cake Liquids/Solids, W/W | 6.7 | 6.8 | 6.6 | 3.8 | 4.1 | 3.8 |
| DWO Pour/Solid, °C. | −12/−15 | −12/−15 | −12/−15 | −12/−15 | −12/−15 | −12/−15 |
| DWO Filter Rates(3) (USG/Ft²-Hr) | 2.67 | 2.72 | 3.55 | 3.15 | 4.33 | 4.07 |
| DWO Rel. Filtration Rate | 1.00 | 1.00 | 1.32 | 1.17 | 1.61 | 1.51 |
| Feed Rel. Filtration(3) Rate | 1.00 | 1.00 | 1.29 | 1.14 | 1.59 | 1.48 |

(1)No drying applied to filter cake.
(2)Oil contents before cake wash determined by mass balance. Oil contents after cake wash determined with ethylene dichloride at −18° C.
(3)Filter rate calculated for rotary filter, 2¼ min/rev, 60 second filtering. Ave. filter rate of waxy feed in reference runs 1 and 2 is 3.22 USG/Ft²-Hr.

What is claimed is:

1. A solvent dewaxing process comprising mixing a waxy hydrocarbon oil bright stock with dewaxing solvent and a dewaxing aid wherein said dewaxing aid comprises a mixture of:

A. poly di alkyl fumarate/vinyl acetate copolymers wherein the pendent alkyl side chain groups are from $C_{16}$ to $C_{24}$+ carbons in length with an average pendent side chain length of predominantly (>50%) $C_{20}$; and B. polyalkyl (meth-) acrylate polymer wherein said polymer is an ester of aliphatic alcohols of 10 to 20 carbons in length but predominantly (>50%) $C_{14}$ and lower, with acrylic or methacrylic acid wherein components (A) and (B) constituting the dewaxing aid are used in a weight ratio to each other ranging from about 4/1 to 1/100 of (A)/(B); and chilling said oil/dewaxing solvent/dewaxing aid mixture to form a slurry comprising solid particles of wax and a solution of dewaxed oil and dewaxing solvent and separating said wax from said solution.

2. The process of claim 1 wherein said poly dialkyl fumarate/vinyl acetate copolymer has a number average molecular weight of about 1,000 to 100,000 and wherein said poly alkyl (meth-) acrylate polymer has a number average molecular weight of greater than about 5,000.

3. The process of claims 1 or 2 wherein said dewaxing aid is employed at a dose level ranging from about 0.005 to 5 wt.% active ingredient.

4. The process of claim 3 wherein components (A) and (B) constituting the dewaxing aid are used in a weight ratio to each other ranging from about 1/1 to 1/20 of (A)/(B).

5. The process of claim 4 wherein said dewaxing solvent is (1) $C_3$–$C_6$ ketones and mixtures thereof; (2) aromatic hydrocarbons; (3) mixtures of ketones and aromatic hydrocarbons; (4) halogenated hydrocarbons; (5) N-alkylpyrrolidone; (6) mixtures of acetone and methylene chloride.

* * * * *